US010679480B2

(12) United States Patent
Eckert et al.

(10) Patent No.: US 10,679,480 B2
(45) Date of Patent: Jun. 9, 2020

(54) EVENT INDICATOR SYSTEM

(71) Applicants: Paul L. Eckert, Dousman, WI (US); Christopher B. Hisey, Burlington, WI (US)

(72) Inventors: Paul L. Eckert, Dousman, WI (US); Christopher B. Hisey, Burlington, WI (US)

(73) Assignee: Paul L. Eckert, Dousman, WI (US)

( * ) Notice: Subject to any disclaimer, the term of this patent is extended or adjusted under 35 U.S.C. 154(b) by 0 days.

(21) Appl. No.: 16/206,007

(22) Filed: Nov. 30, 2018

(65) Prior Publication Data

US 2019/0295397 A1 Sep. 26, 2019

Related U.S. Application Data

(60) Provisional application No. 62/646,872, filed on Mar. 22, 2018.

(51) Int. Cl.

| | |
|---|---|
| ***G08B 13/00*** | (2006.01) |
| ***G08B 17/08*** | (2006.01) |
| ***G08B 7/06*** | (2006.01) |

(52) U.S. Cl.

CPC ..... *G08B 17/08* (2013.01); *G08B 7/062* (2013.01); *G08B 7/066* (2013.01)

(58) Field of Classification Search

CPC ..... G08B 17/08; G08B 7/062; G08B 7/066

(Continued)

(56) References Cited

U.S. PATENT DOCUMENTS

| | | | |
|---|---|---|---|
| 3,949,362 | A | 4/1976 | Doyle et al. |
| 4,801,928 | A | 1/1989 | Minter |

(Continued)

FOREIGN PATENT DOCUMENTS

| | | | |
|---|---|---|---|
| CN | 201399164 | Y | 2/2010 |
| CN | 201791279 | U | 4/2011 |
| DE | 19823691 | A1 | 12/1999 |

OTHER PUBLICATIONS

Rondeau, "Adaptive RF Technology," DARPA, Defense Advanced Research Projects Agency, <https://www.darpa.mil/program/adaptive-rf-technologies> webpage available as early as Jul. 3, 2015.

(Continued)

*Primary Examiner* — Zhen Y Wu

(74) *Attorney, Agent, or Firm* — Michael Best & Friedrich LLP

(57) ABSTRACT

A system is configured to assist occupants of a building in response to an active shooter situation. A plurality of sensor units are arranged in the building to detect a gunshot and generate a signal indicative of the gunshot. A processing system determines an approximate location of the gunshot based on the signal and determines safe areas and unsafe areas in the building based on the approximate location of the gunshot. A plurality of output devices are in the building and in communication with the processing system. The output devices indicate an evacuation path within the safe areas with a first graphic and indicate the unsafe areas with a second graphic that is different from the first graphic. An indicator is arranged in a room and generates a lock down indication to notify occupants to stay in the room in response to the processing system receiving the signal.

24 Claims, 6 Drawing Sheets

(58) Field of Classification Search
USPC ..... 340/541
See application file for complete search history.

(56) References Cited

U.S. PATENT DOCUMENTS 5,014,167 A 5/1991 Roberts
5,140,301 A 8/1992 Watanabe
5,355,284 A 10/1994 Roberts
5,923,243 A 7/1999 Bleiner
6,005,724 A 12/1999 Yamato et al.
6,150,943 A * 11/2000 Lehman ..... G08B 7/062 340/332
6,369,899 B1 4/2002 Hamada
6,422,728 B1 7/2002 Riggin
6,460,999 B1 10/2002 Suzuki
6,646,545 B2 11/2003 Bligh
6,685,347 B2 2/2004 Grutze
6,733,134 B2 5/2004 Bleiner
6,965,541 B2 * 11/2005 Lapin ..... G01S 3/8003 367/118
7,192,172 B1 3/2007 Alberti
7,460,020 B2 12/2008 Reyes et al.
7,800,511 B1 * 9/2010 Hutchison ..... G08B 7/066 340/3.1
8,825,387 B2 * 9/2014 Mays ..... G01C 21/206 701/433
9,286,790 B2 * 3/2016 Lyman ..... H04W 4/90
9,564,041 B1 * 2/2017 Dedeaux ..... G08B 25/009
2002/0003470 A1 * 1/2002 Auerbach ..... F41H 11/00 340/425.5
2002/0057204 A1 * 5/2002 Bligh ..... G08B 7/062 340/691.1
2005/0286247 A1 * 12/2005 Peterson ..... F21S 8/032 362/249.01
2006/0071802 A1 4/2006 Right et al.
2007/0069882 A1 * 3/2007 Mahajan ..... E05B 65/104 340/500
2007/0273550 A1 11/2007 Price et al.
2008/0099662 A1 5/2008 Musiel et al.
2008/0266065 A1 * 10/2008 Kennedy ..... G08B 7/062 340/332
2009/0001891 A1 * 1/2009 Patterson ..... G08B 7/066 315/129
2010/0023252 A1 * 1/2010 Mays ..... G01C 21/3423 701/533
2010/0188023 A1 * 7/2010 Anderson ..... F21S 8/032 315/312
2010/0264217 A1 * 10/2010 Kumhyr ..... G08B 15/02 235/400
2011/0136463 A1 * 6/2011 Ebdon ..... G01C 21/20 455/404.1
2011/0169633 A1 * 7/2011 Lauder ..... G01S 3/80 340/539.13
2011/0267179 A1 * 11/2011 Patterson ..... G08B 7/066 340/286.02
2012/0038479 A1 * 2/2012 Ten Wolde ..... F21V 23/0442 340/540
2012/0063270 A1 * 3/2012 Angell ..... G01S 5/0027 367/127
2012/0275273 A1 * 11/2012 Showen ..... G01S 5/0036 367/127
2013/0169817 A1 * 7/2013 Jones ..... G08B 25/14 348/159
2014/0266690 A1 * 9/2014 McKinley ..... G08B 25/006 340/539.11
2014/0340222 A1 11/2014 Thornton et al.
2014/0361886 A1 * 12/2014 Cowdry ..... G08B 13/1672 340/522
2015/0124087 A1 * 5/2015 Jones, Jr. ..... G08B 13/19695 348/143
2015/0204109 A1 * 7/2015 Ergenbright ..... G05B 13/00 340/541
2015/0244873 A1 * 8/2015 Boyden ..... H04R 27/00 379/39
2016/0003428 A1 * 1/2016 Anderson ..... F21S 8/033 362/147
2016/0133107 A1 * 5/2016 Showen ..... G08B 17/08 340/540
2016/0232774 A1 * 8/2016 Noland ..... G08B 13/1672
2016/0247369 A1 * 8/2016 Simmons ..... G08B 7/066
2016/0247374 A1 * 8/2016 Crowe ..... G08B 15/02
2016/0269882 A1 * 9/2016 Balthasar ..... H04W 4/90
2016/0358393 A1 * 12/2016 Penland ..... G08B 13/19695
2017/0123038 A1 * 5/2017 Griggs ..... G08B 13/1672
2017/0169686 A1 * 6/2017 Skorpik ..... G08B 21/02
2018/0053394 A1 * 2/2018 Gersten ..... H04R 27/00 379/39
2018/0122030 A1 * 5/2018 Raz ..... G05B 19/0428
2018/0122220 A1 * 5/2018 Billig ..... G08B 21/02
2019/0158305 A1 * 5/2019 Cui ..... G08B 15/02
2019/0212186 A1 * 7/2019 Warren ..... G01S 5/0036 367/127
2019/0230467 A1 * 7/2019 Williams ..... G08B 13/1672 340/522
2019/0376838 A1 * 12/2019 Frey ..... G08B 15/02 235/400

OTHER PUBLICATIONS

International Search Report and Written Opinion for Application No. PCT/US2019/022708 dated Jun. 25, 2019 (17 pages).

* cited by examiner

EVENT INDICATOR SYSTEM

CROSS-REFERENCE TO RELATED APPLICATIONS

This application claims priority to U.S. Provisional Patent Application No. 62/646,872 filed on Mar. 22, 2018, the entire content of which is incorporated herein by reference.

FIELD OF THE INVENTION

The invention is a system which, in a dangerous event, detects threats and communicates recommended actions to reduce casualties among event participants.

BACKGROUND OF THE INVENTION

Mass casualty crimes are on the rise in schools, office buildings, large venue gathering places and other public locations around the world. There is a critical global need to reduce the number of human casualties in high risk situations. While emergency responders make every effort to react quickly and effectively to protect lives, there are viable solutions which could reduce casualties and further protect the lives of innocent people caught in dire situations. The exact number of these events varies by the definition used, but it seems they are increasing in terms of both frequency and number of casualties. In many cases, victims are not able to reach safety in time, in part due to the chaotic nature of a highly stressful and fast-moving event and in part due to current emergency systems being inadequate in guiding people to safety. Finding the fastest means to evacuate people from schools, churches, sports venues, personal residences, and other buildings is of the utmost importance in assuring a casualty-free or reduced casualty outcome as a result of dangerous events. It is therefore in the best interest of all participants involved in the event to design a better system to improve their chance of escaping unscathed. The purpose of the system described below is to improve upon current systems to reduce the number of human casualties in a variety of high risk scenarios.

SUMMARY OF THE INVENTION

An Event Indicator System (hereafter referred to as the "system" or "EIS") will detect the location of a dangerous event and will respond by performing several actions. These actions will shorten emergency response time and aid in separating potential victims from a nearby threat thereby reducing the number of human casualties. The functions of the system may include but are not limited to the following basic functions: (1); Detect an event; (2) Determine the event threat type and severity level; (3) Notify emergency responders; (4) Communicate location of the threat and direction to safety; and (5) Collect and compile event data.

The present invention provides, in one aspect, a system configured to assist occupants of a building in response to an active shooter situation. The system comprises a plurality of sensor units configured to be arranged in the building to detect a gunshot and generate a signal indicative of the gunshot within the building. The system also comprises a processing system in communication with the plurality of sensors to receive the signal. The processing system is configured to determine an approximate location of the gunshot based on the signal and determine safe areas and unsafe areas in the building based on the approximate location of the gunshot. The system also comprises a plurality of output devices in communication with the processing system configured to be arranged in the building. The output devices are configured to indicate an evacuation path within the safe areas with a first graphic and indicate the unsafe areas with a second graphic that is different from the first graphic. The system also comprises an indicator configured to be arranged in a room of the building and configured to generate a lock down indication to notify occupants to stay in the room in response to the processing system receiving the signal.

The present invention provides, in another aspect, a system configured to evacuate occupants of a building in response to an active shooter situation. The system comprises a plurality of sensor units configured to be arranged in the building to detect a gunshot and generate a signal indicative of the gunshot within the building. The system further comprises a processing system in communication with the plurality of sensors to receive the signal. The processing system is configured to determine an approximate location of the gunshot based on the signal and determine safe areas and unsafe areas in the building based on the approximate location of the gunshot. The system further comprises a plurality of output devices in communication with the processing system configured to be arranged in the building. The output devices are configured to indicate an evacuation path within the safe areas with a first graphic and indicate the unsafe areas with a second graphic that is different from the first graphic.

The present invention provides, in another aspect, a method of evacuating occupants of a building in response to an active shooter situation. The method comprises using a sensor unit to detect a gunshot within the building and in response to detecting the gunshot, generating a signal indicative of the gunshot. The method further comprises receiving the signal at a processing system that is in communication with the sensor unit and in response to receiving the signal at the processing system, determining an approximate location of the gunshot within the building. In response to determining the approximate location of the gunshot within the building, safe areas within the building and unsafe areas are determined within the building. The method further comprises using a plurality of output devices to indicate an evacuation path within the safe areas with a first graphic, and using the plurality of output devices to indicate the unsafe areas with a second graphic that is different from the first graphic.

The present invention provides, in another aspect, a system configured to assist occupants of a building in response to an active shooter situation. The system comprises a plurality of sensor units configured to be arranged in the building to detect a gunshot and generate a signal indicative of the gunshot within the building. The system also comprises a processing system in communication with the plurality of sensors to receive the signal. The system also comprises an indicator configured to be arranged in a room of the building. The indicator is configured to generate a lock down indication to notify occupants to stay in the room in response to the processing system receiving the signal.

The present invention provides, in yet another aspect, a system configured to detect a gunshot. The system comprises an application on a smartphone configured to allow the smartphone to detect a gunshot and generate a signal indicative of the gunshot. The system also comprises a processing system in communication with the application to receive the signal. The processing system is configured to determine an approximate location of the gunshot based on the signal.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DEFINITIONS

The term "EVENT" is defined as an occurrence of smoke, fire, gunshot or any other dangerous occurrence unless otherwise described.

The term "ACTIVE SHOOTER" or "SHOOTER" is defined as an individual actively engaged in killing or attempting to kill or injure people, especially in a confined or populated area.

The term "THREAT" is defined as a person or thing likely to cause damage or danger.

DETAILED DESCRIPTION OF THE INVENTION

Detect an Event

Figure 1:
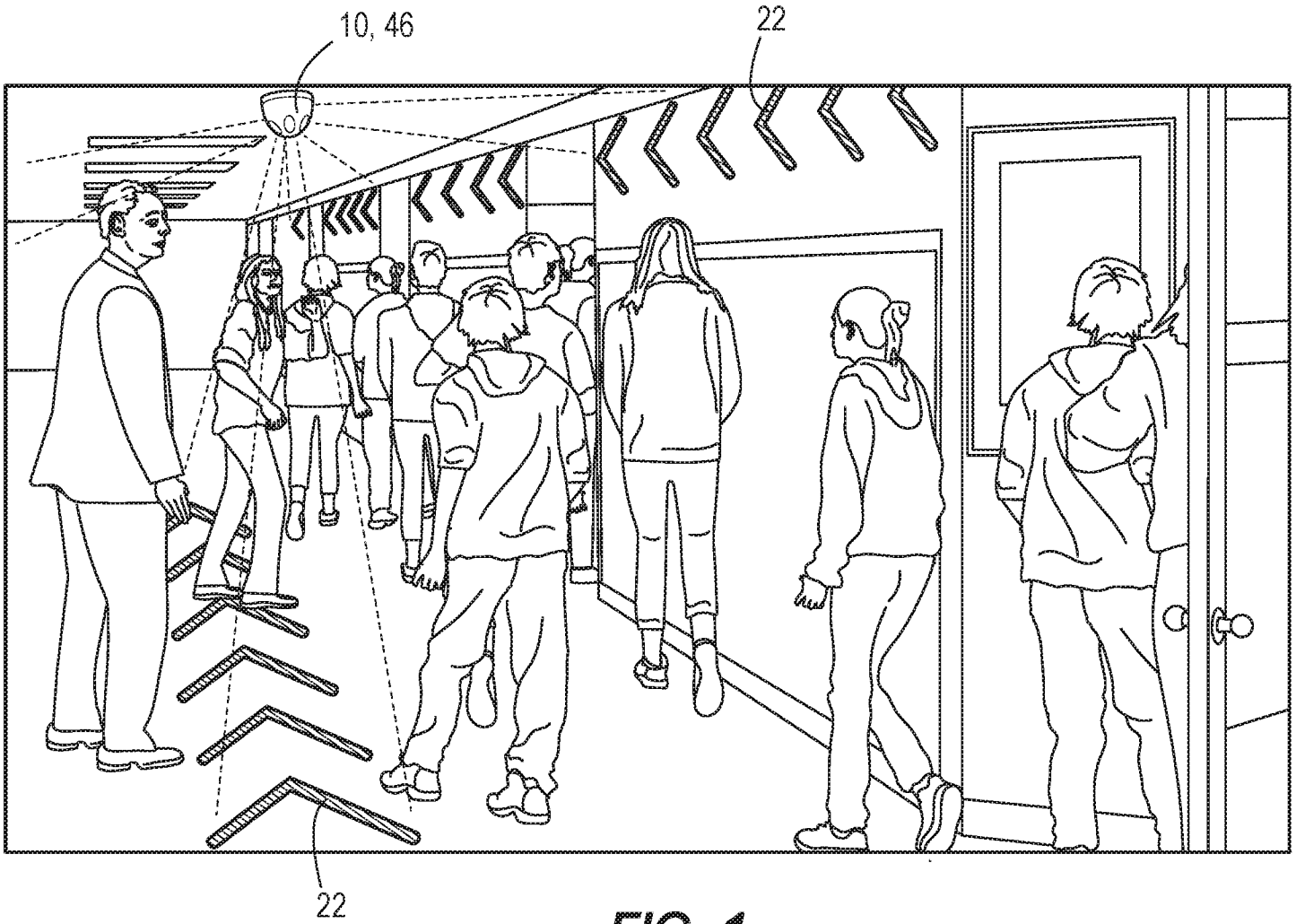
FIG. 1 is a perspective view of a school hallway with an event indicator system and with students evacuating in the direction of graphic indicators.
Figure 2:
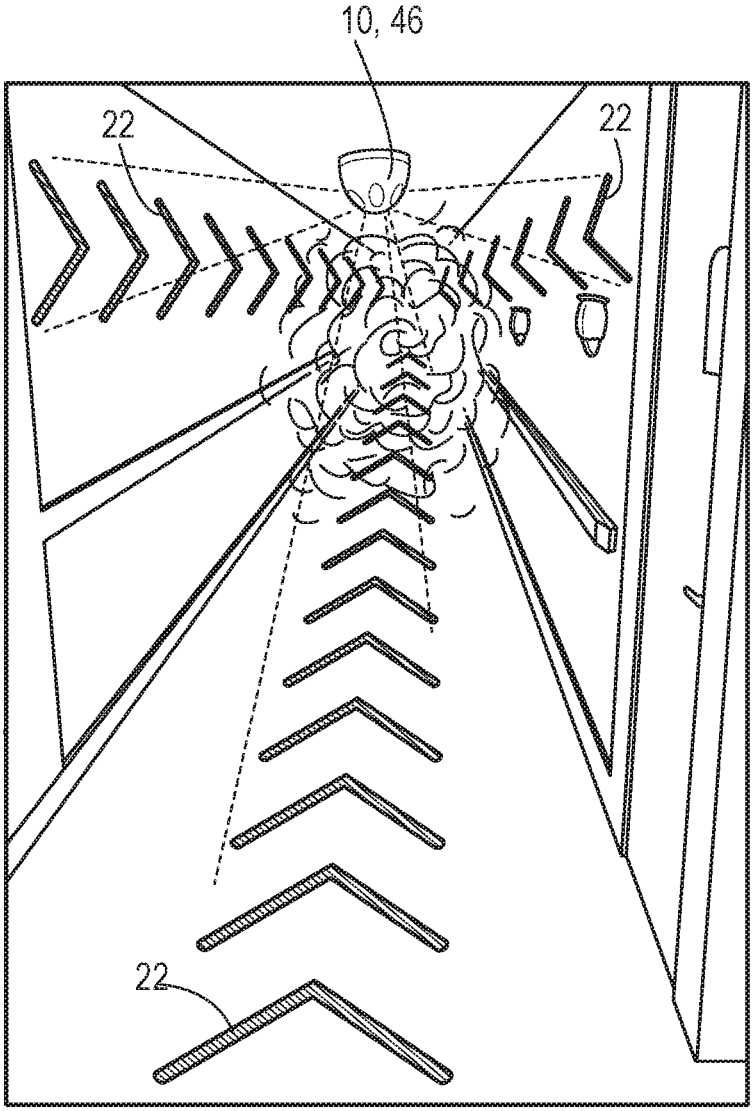
FIG. 2 is a perspective view of a hallway with the event indicator system of FIG. 1, the hallway filled with smoke and including graphic indicators showing a safe route to evacuate.

The EIS receives information using sensor device units 10 (FIGS. 1 and 2) which are strategically placed throughout a building to detect an emergency event, such as a fire, active shooter event, chemical, carbon monoxide, hazmat, tornado, flood, bomb threat, suspicious package, etc. For example, in the case of an active shooter event, sensors 10 will detect an audible boom sound from a gunshot. In some embodiments, the sensors 10 include microphones to detect the sound of a gunshot. Sensors 10 will be positioned throughout the building at critical areas such as north and south doors 14 and 18 (FIG. 4), large gathering areas and some designated rooms. The sensor unit 10 can detect a variety of sensory events caused by a gunshot such as high decibel audible boom sound, muzzle flash, or gunpowder smoke etc. within the detectable area of the sensor unit 10 and in response, relay a signal indicative of a gunshot to a main processing system. In response to receiving the signal from the sensor unit 10, the main processing system can determine the approximate or exact location of the gunshot within the building. Other emergency events such as a fire, hazmat situation etc. may also be detected by the sensor unit and possible integration with camera technology for facial recognition or other personal identification methods such as phone ID.

In some embodiments, an application (the "App") is available for download to a smartphone. The App is configured to use the GPS location of the smartphone and also configured to use the microphone of the smartphone as a sensor that can detect a gunshot by detecting noise above a certain decibel level. Thus, if a person having a smartphone with the App is in a building with an EIS and an active shooter 20 fires a shot proximate (i.e., within a detectable distance of) the person, the smartphone detects the gunshot and sends a signal indicative of the gunshot to the EIS main processing system. For example, after detecting the gunshot, the App may send a signal indicating the GPS location of the smartphone to the EIS main processing system, and the EIS automatically determines that a gunshot has been detected merely by receiving the GPS location from a phone having the App. In response to receiving the signal, the EIS main processing system can determine the approximate location of the gunshot within the building. As described in further detail below, the EIS main processing system uses the approximate location of the shot as detected by the smartphone, alone or in combination with the sensor device units 10 mounted in the building, to indicate safe and unsafe areas within the building. If there are multiple people in a building with smartphones having the App that detect the gunshot, the EIS main processing system may receive multiple GPS locations corresponding to the location of the smartphones within the building. In this manner, the EIS main processing system can triangulate the multiple GPS locations to approximate the location of the active shooter 20 in the building, and indicate safe and unsafe areas accordingly.

If a gunshot is fired in proximity to a smartphone with the App outside a building or inside a building that lacks an EIS, the App may recognize that the phone is not inside an EIS building and thus, instead of sending a signal to the EIS main processing system, may just send a GPS location signal to a server or processing system at nearby local law enforcement authorities, alerting them to the approximate location of the gunshot.

Determine the Event Threat Type and Severity Level

The EIS main processing system will be able to determine the threat type and severity level that was sensed by the sensor unit(s) and will initiate a response which is appropriate for the event detected. For example, the system can detect the difference between a gunshot and a fire within the building so it can notify the proper emergency responders to the event, i.e. police and/or fire departments. Additionally, the EIS will use the threat information to calculate the safest route out of the building (as described in sections below). The system can distinguish between safe and unsafe zones, based on sensor unit 10 locations and pre-programmed floor plan layouts such as the one shown in FIG. 4.

Figure 3:
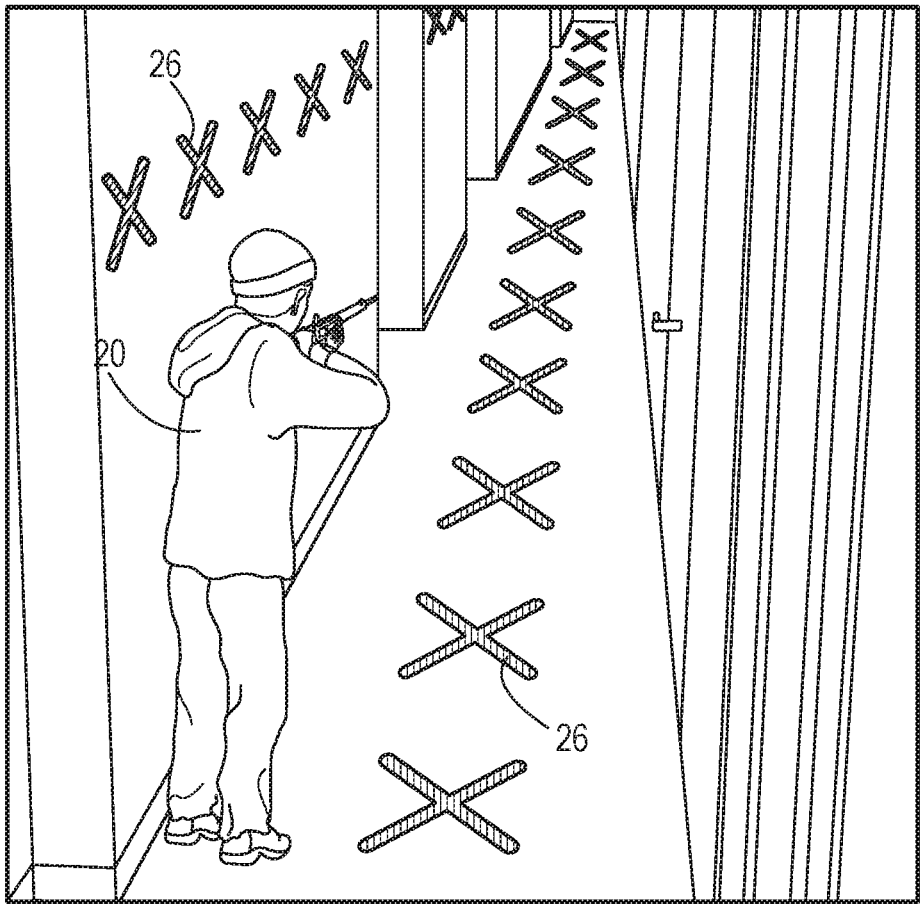
FIG. 3 is a perspective view of a hallway with the event indicator system of FIG. 1 and an active shooter present and "X" graphic indicators.
Figure 4:
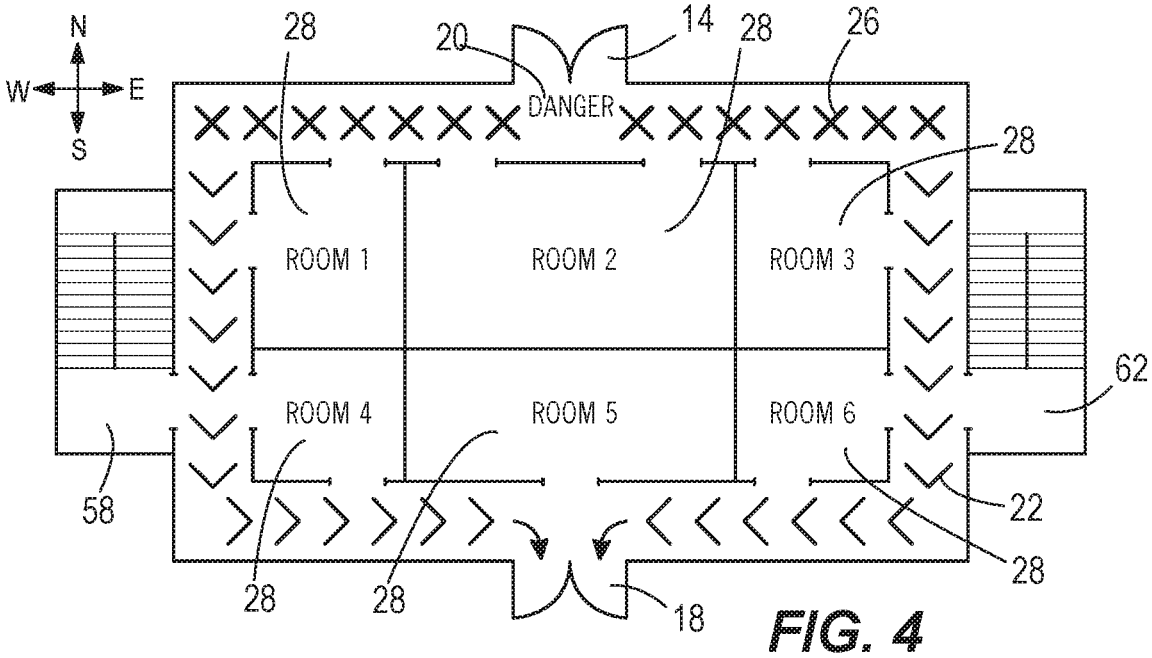
FIG. 4 is a schematic view of a floor plan of a building having the event indicator system of FIG. 1.
Figure 5:
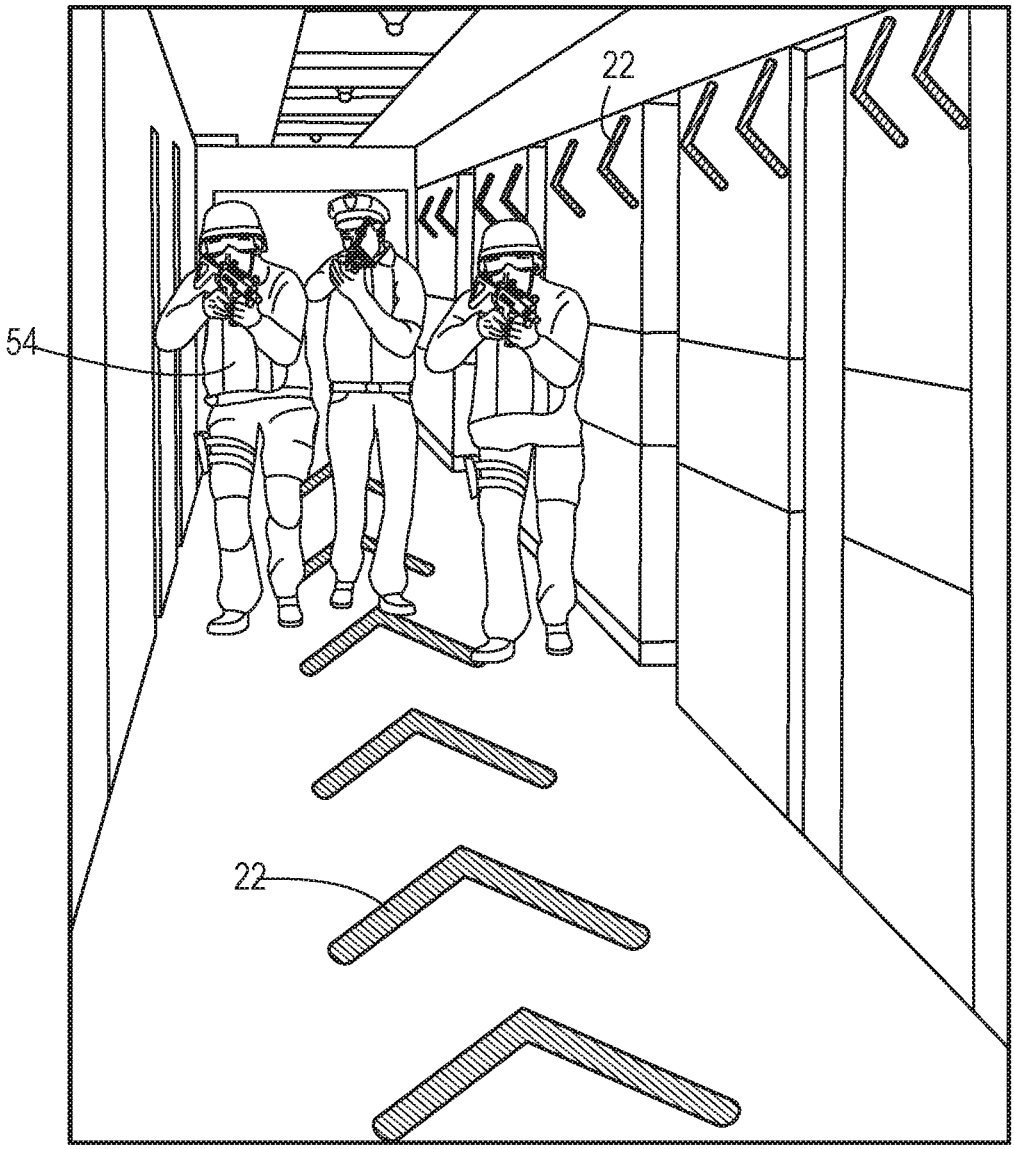
FIG. 5 is a perspective view of a hallway with the event indicator system of FIG. 1 and Emergency Responders walking against the direction of graphic indicators.

In some embodiments, to manage a dangerous scenario, safe areas can be indicated with a first graphic such as "green arrows" 22 (FIGS. 1 2, 4 and 5) and unsafe areas can be indicated with a second graphic that is different from the first graphic, such as "red X's" 26 (FIGS. 3 and 4).

Indicate Threat to Occupants in Individual Rooms

Figure 8:
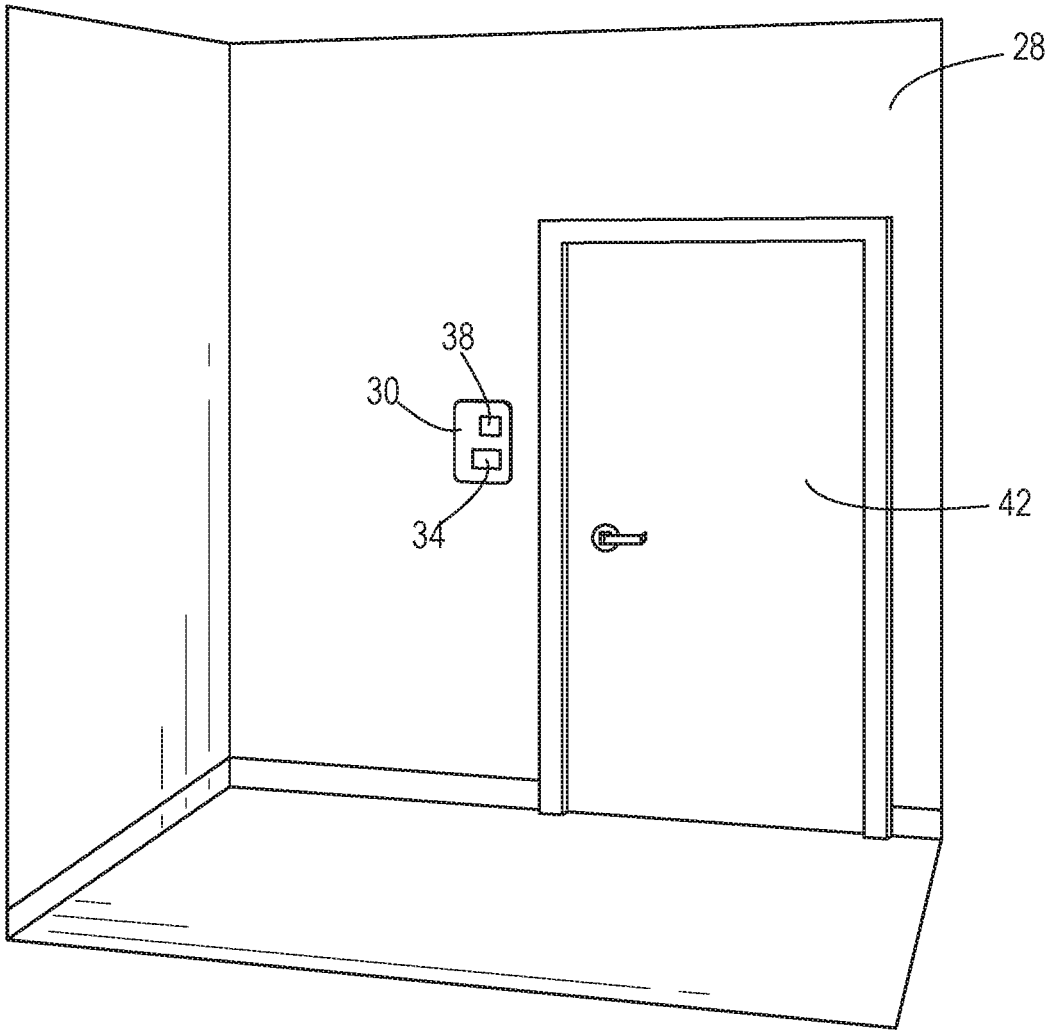
FIG. 8 is a perspective view of a room in a building having an interface of the event indicator system of FIG. 1.

In some embodiments, each room 28 of the building includes an interface 30 having an indicator 34 and an input control 38 (FIG. 8). In other embodiments, each room 28 includes the indicator 34 and input control 38 separate from an interface 30. The indicator 34 and input control 38 are in communication with the EIS main processing system. In response to the EIS main processing system detecting and determining a certain threat type, the EIS main processing system causes the indicator 34 to generate either a lock down indication or an exit indication that is different from the lock down indication. In some embodiments, the indicator 34 is a light and the lock down indication is a displayed red light and the exit indication is a displayed green light. In other embodiments, the indicator 34 is a speaker and the lock down indication may be a first noise or message and the exit indication will be a second noise or message. In some embodiments, the interface 30 or indicator 34 is arranged proximate a door 42 of the room 28 so it is easy for one or more occupants of the room 28 to quickly assess whether the indicator 34 is generating a lock down or exit indication. In some embodiments, the indicator 34 can indicate what type of threat, such as gunshot or fire, has been detected.

If the EIS main processing system has detected a fire, the indicator 34 will indicate there is a fire and generate an exit indication, thereby instructing the one or more occupants of the room to exit the room 28 and follow the green arrows 22 to get out of the building.

If the EIS main processing system has detected a gunshot, the indicator 34 will indicate there is an active shooter 20 and generate a lock down indication, thereby instructing the one or more occupants of the room 28 to barricade the door 42, stay in the room 28 and await emergency assistance. Once the room 28 has been barricaded and secured, an occupant of the room may activate the input control 38 to indicate the room is secure. In some embodiments, once the input control 38 has been activated to indicate that the room 28 is secure, the occupants inside the room 28 will go to a designated safe spot within the room 28, as part of an EIS occupant response protocol that can be taught during an EIS training protocol. In some embodiments, the safe spot is a spot farthest from the door 42. In some embodiments, the room 28 has ballistic paneling on the interior of the room walls that are proximate the safe spot. In some embodiments, the ballistic paneling would be on the interior of all the walls. In some embodiments, the ballistic paneling would blend into the interior design of the walls.

In some embodiments, the input control 38 can be one of a switch, button, number key pad, key, thumb scan, or face recognition scan, etc. When the input control 38 has been activated, a signal is sent to the EIS main processing system to indicate the room 28 is secure. Thus, emergency responders coming to the building will know that the room 28 is secure, thereby allowing them to turn their attention to other rooms or hallways in the building that are not secure. Once the active shooter has been stopped, responders 54 can use the EIS main processing system to cause the indicator 34 to generate the exit indication, instructing the occupants of the room 28 that they may safely exit the room 28.

Notify Emergency Responders

The EIS main processing system will determine which agencies to notify based on the type and severity level of the event. In the case of an active shooter 20, the system will communicate information to the responding law enforcement officers regarding the building layout (blueprint), the approximate or exact location where the first shot was fired, and the location within the building of subsequent follow up shots including last shots fired in real time. The purpose of real time event location tracking is to give emergency responders a more precise account of the location of the moving threat enabling a faster response time. Information including a building floor plan (FIG. 4), including which rooms have been marked as "secure" with input controls 38, could be sent through software integrated with an IPad, phone, computer, electronics or other devices currently on the market or be sent directly to central dispatch personnel using existing or new automatic response communication systems. This information can be utilized throughout the event with real time updates sent to central dispatch personnel and emergency responders wherever they may be located.

Communicate Location of the Threat and Direction to Safety

Contained within the sensor units 10 is an output device unit 46 (hereafter called, "output device") (FIGS. 1 and 2) of the EIS. The output device 46 includes light emitting components capable of producing projected images onto surrounding surfaces such as the floor and walls of a building interior, other surrounding objects or onto particulates in the air. The light could be generated using LEDs, lasers or other light emitting technologies. In other embodiments, the output device 46 could be a fixture separate from sensor unit 10 and mounted on a first surface, such as a ceiling or wall, that projects light onto a second surface, such as a ceiling or wall, that is the same as or different than the first surface. In other embodiments, the output device 46 could be a simple light fixture such as a LED light strip that projects lights on or from the surface on which it is mounted. The output device leverages data from the main processing system to activate one or more of the output devices to produce a specific visual communication graphic, pattern or other visual effect using light (hereafter called, "graphic") which are related to the location of the threat detected. The intent of the graphic is to communicate important information to all participants of an event (building occupants, general public, emergency responders and in some cases, the perpetrator) to influence behavior of all participants toward actions resulting in eliminating or reducing the number of casualties.

The graphic style will vary depending on the event type and severity level. Examples of graphics are, artwork such as arrows, "X's," other directional symbols, text descriptions, animated movement, colors, or any other visual effect best suited to communicate a particular message in a given situation or venue.

In some embodiments, to manage a scenario involving an active shooter 20, the output device 46 indicates safe areas with the first graphic such as "green arrows" 22 (FIGS. 1 2, 4 and 5) and indicates unsafe areas with the second graphic, such as "red X's" 26 (FIGS. 3 and 4). Green arrows 22 indicate direction of safe travel away from the shooter 20 and red X's 26 indicate the location of the shooter or unsafe locations within line-of-sight of the shooter.

Figure 6:
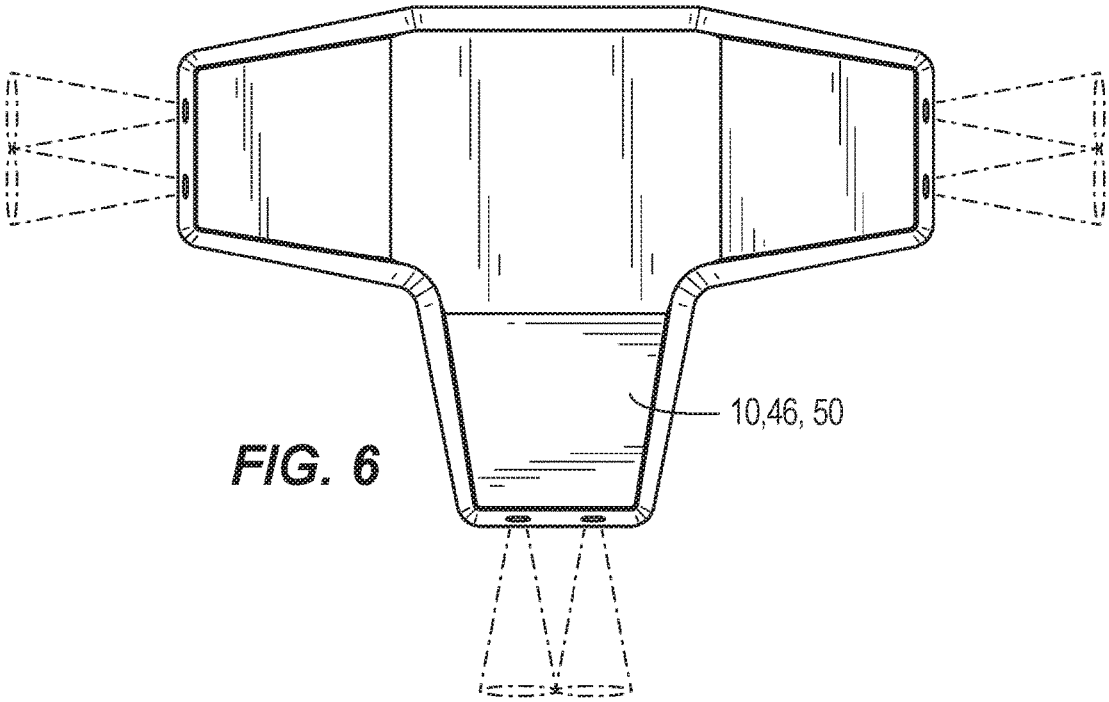
FIG. 6 is a plan view of an output device of the event indicator system of FIG. 1.
Figure 7:
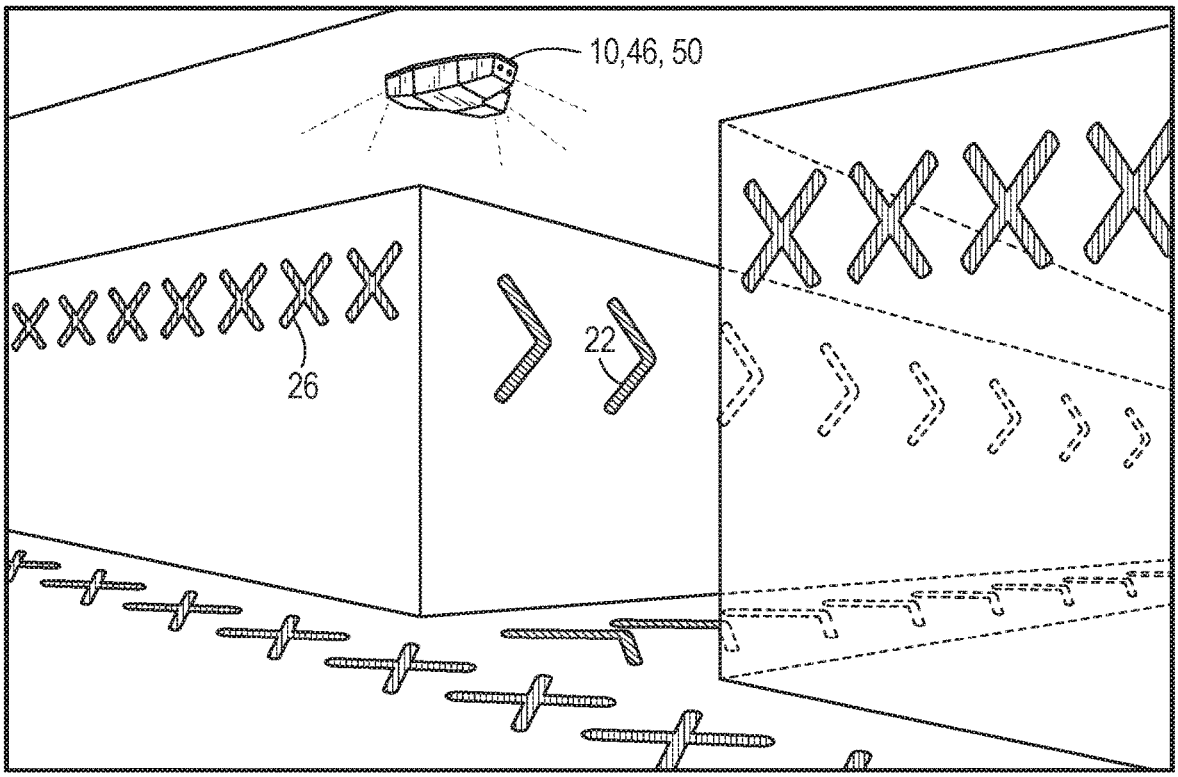
FIG. 7 is a perspective view of the output device of FIG. 6 mounted at a T-intersection in a building.

In some embodiments, the output device 46 can have a T-housing 50 and be capable of projecting lasers, as shown in FIGS. 6 and 7. Thus, as shown in FIG. 7, the output device 46 with the T-housing 50 can be mounted a T-intersection in the building and display the green arrows 22 down the intersecting hallway and display red X's 26 down the intersected, perpendicular hallway or vice versa.

There are three main parties involved in an active shooter event. 1) The building occupants (victims) 2) Emergency Responders (police) and 3) The shooter. Each have a slightly different perspective on the event and require separate descriptions which are outlined below.

1) Building Occupants

For building occupants (such as general public, innocent bystanders, other personnel on site, etc.) during an event, the graphic would communicate best actions to respond to the event such as, "Flight, Fight, or Hide" which is a commonly taught set of action options when deciding how to best react to an immediate threat. Unfortunately, due to the high psychological stress associated with the experience of a life threatening situation, people often panic, react emotionally/irrationally and do not make the best logical decisions to protect themselves or those around them.

The EIS displays various graphics at the event to visually communicate the best recommended actions for occupants so they have a virtual guide assisting them with the decision making process of best route or action to safety. Having such a system in place may have additional psychological benefits by providing participants with a perceived heightened level of protection which could reduce feelings of fear and anxiety leading to better reactionary decisions.

2) Emergency Responders

When Emergency Responders 54 such as Police or Firefighters arrive on scene their goal is to identify the location of the threat so they can effectively neutralize that threat. Most common fire alarm systems in public buildings have "annunciator panels" which are usually located near the main entrance of a building, and contains a blueprint of the building and lights that correspond to where fire alarms are located in the building. The lights will light-up on the panel, indicating where a fire alarm was set off inside the building. While Annunciator Panels are useful, they do not give responding emergency personnel real time information of the exact location of the problem and are of no use at all to those without training in using the system. As an improvement to this system, the IES will update in real time to follow the threat location and direct emergency personnel to the current threat location. The Emergency Personnel would not be required to enter through the doors closest to the annunciator panel, but rather through any door which is best situated to engage and neutralize the threat. Emergency personnel are trained to move toward the direction of the threat so appropriately, they would move in the direction opposite the direction of the projected arrows which are simultaneously directing victims away from the threat. The system would operate similarly whether the threat is a fire, active shooter or other situation. In the case of active shooter, the system would track the shooter which would update the communicated direction for emergency responders so they can locate and engage the threat more quickly. If responders are standing in a "green arrow" 22 area (FIG. 5) but can see an area some distance away which has a visible "Red X," 26 (FIG. 3) this would indicate that the threat is nearby, possibly around a blind corner. This could be an early warning indicator signaling that they should exercise extreme caution when approaching and may help them avoid becoming a casualty when encountering an otherwise hidden threat.

3) The Shooter

The shooter 20 is a participant in the event that requires special consideration with regard to communicating event intel. It is not desirable for the shooter to receive any information about the whereabouts of potential victims/targets. The shooter will have the same ability to see graphics as the victims and emergency responders when he is positioned in area with line-of-sight to the graphics (FIG. 3.) Therefore the system will be designed to minimize "assistance" to the shooter and act as a deterrent for the shooter whenever possible. This can be done by ensuring the system can recognize his location and identify line-of-sight areas from his vantage point and provide graphics that do not guide him in any way to safety or additional victims/targets. In the current embodiment of the idea, this would be done with blinking Red "X's" 26 in areas of the shooters line-of-sight. Other contemplated output methods of deterrents for active shooter include: Gun or other projectile deterrent, *Oleoresin capsicum* (OC) pepper ball, taser, sound, high beam light source, wall barriers, gates, sound, alarm, recorded audio information, visual display, smoke deterrent/smoke curtain. These are all possible methods which could be deployed automatically in addition to, or instead of a projected light graphic. Any or all of these methods including projected light graphic could act simply as a psychological deterrent to cause the shooter H to believe he has lost control of the situation. This could help to de-escalate or bring a faster end to the event if the shooter H believes that he has already lost against an oppositional force.

Collect and Compile Event Data

The system would be capable of collecting and storing useful event details to later use for creating a post-mortem investigation and utilized for statistical, judicial processes and future training.

Operational Scenario

Using the floorplan in FIG. 4 we can describe a typical dangerous event scenario and show how the graphic light projection system could work with occupants, emergency responders and the shooter. This event could be any threat type, such as a fire, chemical spill, bomb etc. but for the purpose of this scenario we will assume that the threat is an active shooter 20 in the location labeled "DANGER" in FIG. 4. The event begins with the active shooter 20 firing a shot with a rifle. The sensor 10 or the App, alone or together, detect that a shot has been fired near the north doors 14 (FIG. 4) just outside Room 1, 2 and 3. The system immediately notifies emergency responders 54 and simultaneously sets off an alarm and projects graphics onto the floors and walls in all hallways within the building, such that occupants in the hallways are aware a threat in the building and must take some emergency action. Occupants in the rooms 28 are notified of the shooter via the indicators 34 of the interfaces 30 generating a lock down indication instructing the occupants to lockdown and barricade the room. Once a certain room 28 has been barricaded and secured, the occupants of that room 28 activate the input control 38 to indicate that the room is secure. The occupants in the room 28 then move to the safe spot in the room 28.

The arrows are animated and move in the direction they are pointing. Occupants in hallways outside of Rooms 4, 5 and 6 see the Green Arrows 22 indicating that they should evacuate in the direction of the arrows. Occupants in the stairways 58, 62 walk into the same hallways and see the Green Arrows 22 and the other people moving in a particular direction, causing them to follow suit and move in this direction. Meanwhile, Emergency Responders 54 (police, swat, fire) are en route to the scene with detailed information from dispatch and a live display in their vehicle indicating the position and latest movements of the shooter. The Emergency Responders 54 are also provided with the building layout, and the specific rooms 28 that are secure or not secure, based on which input controls 38 have been activated. Thus, the Emergency Responders 54 can focus their attention on unsecured rooms and hallways in their pursuit of the shooter.

The shooter 20 sees only Red "X's" 26 and begins to wonder if his brief time in control of the event has already ended. He begins to panic and pauses his shooting trying to determine what is happening. The first responder 54 on scene is a Police Officer who decides to approach and enter through the north doors 14 since that is closest to a current location of the shooter 20 (FIG. 4.) The Officer 54 locates the suspected shooter 20 and commands him to drop his weapon. The shooter 20 is stunned that this ended so quickly and he complies (or attempts suicide). Occupants are quickly evacuating the building through the south doors 18 and by the time additional Police arrive on scene, the occupants in the hallways have evacuated. The first Officer reports over the radio that the suspect is in custody. Additional Emergency Responders (Police Officers and SWAT) enter the building through various entrances to clear the building of any remaining threats. The first responders 54 entering through the south doors 18 immediately follow the opposite direction of the Green Arrows G, having been trained to do so knowing that this direction will lead them directly to the location of the last known threat. Following the opposite direction of the Green Arrows 22 eventually leads them to the area with Red "X's" 26. They approach this area with an appropriate level of caution. The incident ends with emergency responders 54 tending to any casualties including those in shock or distress. The main processing system is set to an "all-clear" mode or reset to a ready-state condition, which instructs the indicators 34 in the rooms 28 to generate the exit indication. Event details are uploaded to a database for review and reporting. The Event Indicator System has played a critical role in neutralizing the threat quickly and reducing the number of human casualties.

Other Contemplated Functionality

In addition to the high risk scenarios described above, the EIS could be useful in low risk scenarios to aid in movement of large crowds. Using sensors to detect areas with low or high numbers of people, the EIS could be useful in any large venue social events such as sporting events, concerts, music festivals, county fairs and the like. Functionality could include: (1) installation of the system in various locations, interior hallways, individual rooms, stairways and exterior locations; (2) Fastest possible traveling routes from any crowded event toward an area of interest or safety; (3) GPS with direct travel to the areas you specifically asking for. App will real time indicate while you're walking to the location chosen; and (4) real time population counting system. The EIS could also be used for situations involving a disorderly person or medical emergency.

EIS Training Protocol

In some embodiments, an EIS training exercise, simulation, or protocol is used to train occupants of a building and/or responders on how to handle an active shooter or fire situation by using the EIS. Specifically, occupants of the building are trained to respond to the indicator 34 in the following manner.

If the active shooter 20 has not yet reached the room 28 in which the occupants are located, when the indicator 34 generates a lock down indication, occupants or the organizer of the occupants (e.g. a teacher) of the room 28 are trained to first lock the door 42. The occupants are then trained to move to the safe spot in the room 28, away from the door 42 and windows, behind certain walls or ballistic paneling walls, and remain on one knee in cover. Once the occupants are in cover, one of the occupants will be trained to activate the input control 38 to send a signal to the EIS main processing system indicating that the door 42 of the room 28 is locked and everyone is in the safe spot. Occupants are then trained to remain in the safe spot and wait for first responders 54.

If the active shooter 20 has already arrived to the room 28 or door 42 before the occupants have had time to react to the lock down indication of the indicator 34, the occupants are trained to employ the fight or flight tactic. In the flight or fight tactic, occupants will flee the room 28, engaging the shooter 20 only if it is impossible not to do so. Once in the hallway, the occupants are then trained to use the green arrows 22 directing them to the nearest exit. Specifically, occupants are trained to follow the direction of the green arrows 22 and avoid wherever they see red X's 26.

During an active shooting scenario, the first responders 54 are trained to use the EIS in the following manner. When the first shot is detected, the EIS sends critical information to first responders 54 regarding the location of the active shooter 20, indicating on the mapping system of the building where the last shot was fired. The first responders 54 are trained to go directly to the shooter 20 or the building entrance that is nearest to the location of the shot. First responders 54 are trained to go against the direction of the green arrows and head to the area where the red X's 26 are being projected, thus moving them in the fastest direction towards the active shooter 20.

In the event of a fire, the indicator 34 will generate an exit indication, and occupants are trained to immediately exit the room 28 upon receiving the exit indication. Once out of the room, the occupants are trained to use the green arrows 22 and red X's 26 to exit the building as described above. The organizer (e.g. teacher) or last occupant to exit the room 28 activates the input control 38 to send a signal to the EIS main processing system to indicate that the room is cleared, thus letting first responders 54 know they do not need attempt rescue on that particular room 28. The EIS main processing system will provide a blue print of the building to the first responders 54 to show what rooms are evacuated and what rooms are not evacuated.

Components

The following components may be contained in one single device or contained in separate devices which are networked together using a wired or wireless connectivity system: (1) Sensor Device(s) 10; (2) Main Processing System(s); (3) Output device(s) 46; Indicator(s) 34; and (5) Input Control(s) 38.

Various features of the invention are set forth in the following claims.

What is claimed is:

1. A system configured to assist occupants of a venue having a plurality of hallways, in response to an active shooter situation, the system comprising:

a plurality of sensor units configured to be arranged in the hallways to detect a first gunshot and a plurality of subsequent gunshots and respectively generate a first signal and a plurality of subsequent signals, each of the signals respectively indicative of the first gunshot and each of the plurality of subsequent gunshots within the hallways;

a processing system in communication with the plurality of sensors to receive the signals, wherein the processing system is configured to determine which hallways are safe hallways and which hallways are unsafe hallways in the venue based on the first signal received by the processing system;

a plurality of output devices in communication with the processing system and configured to be arranged in the hallways, each of the output devices configured to project a first graphic onto a surface of one of the safe hallways to indicate an evacuation path within the safe hallways and configured to project a second graphic onto a surface of one of the unsafe hallways to indicate the unsafe hallways, the second graphic being different from the first graphic; and an indicator configured to be arranged in a room of the venue and configured to generate a lock down indication to notify occupants to stay in the room in response to the processing system receiving the signal, wherein the processing system is configured to, in real time, update the determination of which hallways are safe hallways and which hallways are unsafe hallways in response to each of the subsequent signals received from the sensor units, wherein the plurality of output devices are configured to update, in real time, their respective projections of the first graphic or the second graphic based on the updated determination of which hallways are safe hallways and which hallways are unsafe hallways, and wherein the sensor units include a smartphone having an application, the application configured to allow the smartphone to detect the first and subsequent gunshots and communicate the first and subsequent signals to the processing system.

2. The system of claim 1, wherein the indicator is further configured to generate an exit indication for the occupants to exit the room, the exit indication being different than the lock down indication.

3. The system of claim 1, further comprising an input control configured to be arranged in the room of the venue, the input control configured to be activatable by an occupant in the room to indicate that the room is secured.

4. The system of claim 3, further comprising an interface configured to be arranged in the room of the venue, and wherein the input control and indicator are arranged on the interface.

5. The system of claim 3, wherein in response to the input control being activated, the processing system is configured to notify a responder that the room is secure.

6. The system of claim 1, wherein the sensor units are configured to detect at least one of a high decibel audible boom sound, a muzzle flash, or gunpowder smoke.

7. The system of claim 1, wherein the venue is one of a building, a concert venue, or a sports arena.

8. The system of claim 1, wherein the output devices include light projecting components that are mounted on a first surface and are configured to project light onto a second surface that is different than the first surface.

9. The system of claim 2, wherein the lock down indication is a first color light and the exit indication is a second color light that is different from the first color light.

10. A system configured to assist occupants of a building having a plurality of hallways, in response to an active shooter situation, the system comprising:

a plurality of sensor units configured to be arranged in the hallways to detect a first gunshot and a plurality of subsequent gunshots and respectively generate a first signal and a plurality of subsequent signals, each of the signals respectively indicative of the first gunshot and each of the plurality of subsequent gunshots within the hallways;

a processing system in communication with the plurality of sensors to receive the signals, wherein the processing system is configured to determine which hallways are safe hallways and which hallways are unsafe hallways in the building based on the first signal received by the processing system; and a plurality of output devices in communication with the processing system and configured to be arranged in the hallways, each of the output devices configured to project a first graphic onto a surface of one of the safe hallways to indicate an evacuation path within the safe hallways and configured to project a second graphic onto a surface of one of the unsafe hallways to indicate the unsafe hallways, the second graphic being different from the first graphic, wherein the processing system is configured to, in real time, update the determination of which hallways are safe hallways and which hallways are unsafe hallways in response to each of the subsequent signals received from the sensor units, wherein the plurality of output devices are configured to update, in real time, their respective projections of the first graphic or the second graphic based on the updated determination of which hallways are safe hallways and which hallways are unsafe hallways, and wherein at least one of the output devices is configured to project the first graphic down a first hallway and configured to project the second graphic down a second hallway that is perpendicular to the first hallway.

11. The system of claim 10, wherein each of the plurality of sensor units is arranged within one of the plurality of output units.

12. The system of claim 10, wherein the at least one of the output devices includes a T-housing.

13. The system of claim 10, wherein one or more of the output devices are mounted on a ceiling of one of the hallways.

14. The system of claim 10, wherein one or more of the output devices are mounted on a first wall of the first hallway of the plurality of hallways.

15. The system of claim 14, wherein the one or more output devices mounted on the first wall project the first or second graphic onto a floor of the first hallway.

16. The system of claim 14, wherein the one or more output devices mounted on the first wall project the first or second graphic onto a second wall of the first hallway, the second wall being different from the first wall.

17. The system of claim 10, wherein the first graphic is a moving green arrow and the second graphic is a red X.

18. A system configured to assist occupants of a building having a plurality of hallways, the system comprising:

a plurality of sensor units configured to be arranged in the hallways to detect a type of emergency situation from a predetermined list of emergency situations, each of the plurality of sensor units configured to generate a signal indicative of which emergency situation has been detected and a severity of that detected emergency situation;

a processing system in communication with the plurality of sensors to receive the signal, wherein in response to receiving the signal, the processing system is configured to determine which emergency situation has been detected out of the predetermined list of emergency situations, and the severity of that detected emergency situation; and a plurality of output devices in communication with the processing system and configured to be arranged in the hallways, each of the output devices configured to project a graphic onto a surface of one of the hallways, wherein the projected graphic is different depending on which emergency situation the processing system has determined is occurring, and the severity of that detected emergency situation.

19. The system of claim 18, wherein the predetermined list of emergency situations includes a fire event, an active shooter event, and a bomb threat event.

20. The system of claim 19, wherein the predetermined list of emergency situations further includes a chemical event, a carbon monoxide event, a hazmat event, a tornado event, a flood event, and a chemical event.

21. The system of claim 20, wherein the plurality of sensor units are configured to detect a first gunshot and a plurality of subsequent gunshots and respectively generate a first gunshot signal and a plurality of subsequent gunshot signals, each of the gunshot signals respectively indicative of the first gunshot and each of plurality of subsequent gunshots within the hallways, wherein the processing system is configured to determine which hallways are safe hallways and which hallways are unsafe hallways in the building based on the first gunshot signal received by the processing system, and wherein each of the output devices are configured to project a green arrow onto a surface of one of the safe hallways to indicate an evacuation path within the safe hallways and configured to project a red X onto a surface of one of the unsafe hallways to indicate the unsafe hallways.

22. The system of claim 21, the processing system is configured to, in real time, update the determination of which hallways are safe hallways and which hallways are unsafe hallways in response to each of the subsequent gunshot signals received from the sensor units, and wherein the plurality of output devices are configured to update, in real time, their respective projections of the green arrow or the red X based on the updated determination of which hallways are safe hallways and which hallways are unsafe hallways.

23. A system configured to detect a gunshot, the system comprising:

an application on a smartphone configured to allow the smartphone to detect a gunshot and generate a signal indicative of the gunshot, the signal being a GPS signal indicating an approximate location of the smartphone; and a processing system in communication with the application to receive the signal, wherein the processing system is configured to determine an approximate location of the gunshot based on the signal, wherein the processing system is part of an event indicator system arranged in a building, and wherein if the smartphone is in the building and a gunshot is fired proximate the smartphone, the processing system is configured to determine an approximate location of the gunshot within the building based on the signal, wherein if the smartphone is outside of the building and a gunshot is fired proximate the smartphone, the processing system is configured to determine an approximate location of the gunshot and send a notification indicative of the approximate location to a local law enforcement group, wherein the building has a plurality of hallways, and the processing system is configured to determine which hallways are safe hallways and which hallways are unsafe hallways in the building based on the determination of the approximate location of the gunshot, and wherein the event indicator system includes a plurality of output devices in communication with the processing system and configured to be arranged in the building, each of the output devices configured to project a first graphic onto a surface of one of the safe hallways to indicate an evacuation path within the safe hallways and configured to project a second graphic onto a surface of one of the unsafe hallways to indicate the unsafe hallways, the second graphic being different from the first graphic.

24. The system of claim 23, wherein the processing system is configured to, in real time, update the determination of which hallways are safe hallways and which hallways are unsafe hallways in response to each gunshot detected by the smartphone, and wherein the plurality of output devices are configured to update, in real time, their projections with the first graphic or the second graphic based on the updated determination of which hallways are safe hallways and which hallways are unsafe hallways.

* * * * *